US008341859B2

(12) United States Patent
Culiver et al.

(10) Patent No.: US 8,341,859 B2
(45) Date of Patent: Jan. 1, 2013

(54) SYSTEM FOR MOUNTING A TOWER DISPLAY

(76) Inventors: Kelly Culiver, Newburgh, Warrwick County, IN (US); Andrew Rentsch, Newburgh, Warrwick County, IN (US)

( * ) Notice: Subject to any disclaimer, the term of this patent is extended or adjusted under 35 U.S.C. 154(b) by 0 days.

(21) Appl. No.: 13/331,364

(22) Filed: Dec. 20, 2011

(65) Prior Publication Data

US 2012/0246985 A1 Oct. 4, 2012

Related U.S. Application Data

(60) Provisional application No. 61/516,027, filed on Mar. 28, 2011.

(51) Int. Cl.
*G09F 15/00* (2006.01)

(52) U.S. Cl. ..... 40/606.01; 40/601; 40/606.14; 52/38

(58) Field of Classification Search ..... 40/606.01, 40/601, 606.14; 52/38, 29
See application file for complete search history.

(56) References Cited

U.S. PATENT DOCUMENTS

| | | | | | |
|---|---|---|---|---|---|
| 2,584,713 | A * | 2/1952 | Kanaval | 248/121 |
| 5,685,511 | A * | 11/1997 | Ghany et al. | 248/201 |
| 5,815,966 | A * | 10/1998 | Vestevich | 40/217 |
| 5,964,070 | A * | 10/1999 | Redl et al. | 52/581 |
| 2005/0188571 | A1 * | 9/2005 | Wilson | 40/601 |

* cited by examiner

*Primary Examiner* — Gary Hoge
(74) *Attorney, Agent, or Firm* — Gary K. Price

(57) ABSTRACT

A system for installing and maintaining a display on a structure. The system includes at least one guide system having a pair of guide rails that have a first end accessible from the roofing surface of the structure and a second end attached to the side exterior wall of the structure. The guide rails each define a track that is designed for sliding receipt of guide pins disposed on a bottom side of a frame member. The guide pins are engaged within the track of each of the guide rails and remain engaged within the track of the guide rails such that the frame member can be slidingly positioned on the first end of the guide rails or, in a second position where the frame member is positioned on the second end of the guide rails. A selected display or sign is attached to a top side of the frame member.

19 Claims, 9 Drawing Sheets

SYSTEM FOR MOUNTING A TOWER DISPLAY

CROSS REFERENCES TO RELATED APPLICATIONS

U.S. Provisional Application for Patent No. 61/516,027, filed Mar. 28, 2011, with title "System for Mounting a Tower Display" which is hereby incorporated by reference. Applicant claim priority pursuant to 35 U.S.C. Par. 119(e)(i).

Statement as to rights to inventions made under federally sponsored research and development: Not Applicable

BACKGROUND OF THE INVENTION

1. Field of the Invention

The present invention relates to sign assemblies and more particularly, to an improved system for installing and maintaining a sign typically placed around the top of a tower, high rise building or other structure.

2. Brief Description of Prior Art

In general, buildings, and businesses located in buildings like to be identified. To do so, it is common for a display or sign to be installed around the exterior top of a tower, building, or other structure to identify the name of the building or particular business. The types of businesses that use such signage are unlimited but include banks, hospitals, insurance companies, and the like.

The installation and maintenance of selected signage typically installed around the exterior top of the tower, high rise building or other structure first requires access. Access to the exterior signage location is problematic due to the height of the building. The buildings at issue are generally multi-story buildings with the display installed near the top and, installed on the side(s) of the building. As a result access to the area to install the display or, access to the installed signage for maintenance purposes is not only difficult, but can also be expensive and dangerous.

One solution is by using a piece of heavy equipment to lift the workmen to the selected location at the exterior side of the building. However, this solution can be expensive and inappropriate where for example, the grounds surrounding the building are well manicured causing it difficult for the heavy equipment to reach the desired location without damaging the surrounding landscape. Another solution known in the art is to utilize a suspension system that is temporarily installed and downwardly extends from the roof of the high rise. Such a system is expensive when installing the sign and expensive each time access is required to the sign for maintenance purposes.

As will be seen from the subsequent description, the preferred embodiments of the present invention overcome shortcomings of the prior art.

SUMMARY OF THE INVENTION

Briefly stated, the present invention is directed to a system for installing a display on a high rise building, tower or other structure. The system is equally useful in accessing a previously installed sign for maintenance purposes. The system for mounting a tower display includes at least one guide system including a pair of guide rails that have a first end accessible from the roofing surface of the structure and a second end attached to the side wall of the structure. The guide rails each define a track that is designed for sliding receipt of at least a pair of guide pins disposed on a bottom side of a frame member. The at least a pair of guide pins are engaged with the track of each of the guide rails and remain engaged within the track of the guide rails such that the frame member can be slidingly positioned in a first, or maintenance position where the frame member is positioned on the first end of the guide rails or, the frame member can be slidingly positioned in a second, or display position where the frame member is positioned on the second end of the guide rails. A sign or display is attached to a top side of the frame member of the guide system with the frame member at the maintenance position so that access is easily available from the structure's roofing surface. Once the sign is attached, the frame member can be slidingly positioned along the guide rails until the frame member, with the display attached, is in the display position. In the event maintenance is required on the display, the frame member can be slidingly positioned along the guide rails from the display position until the frame member, with the display attached is in the maintenance position.

DESCRIPTION OF THE PREFERRED EMBODIMENTS

Figure 1:
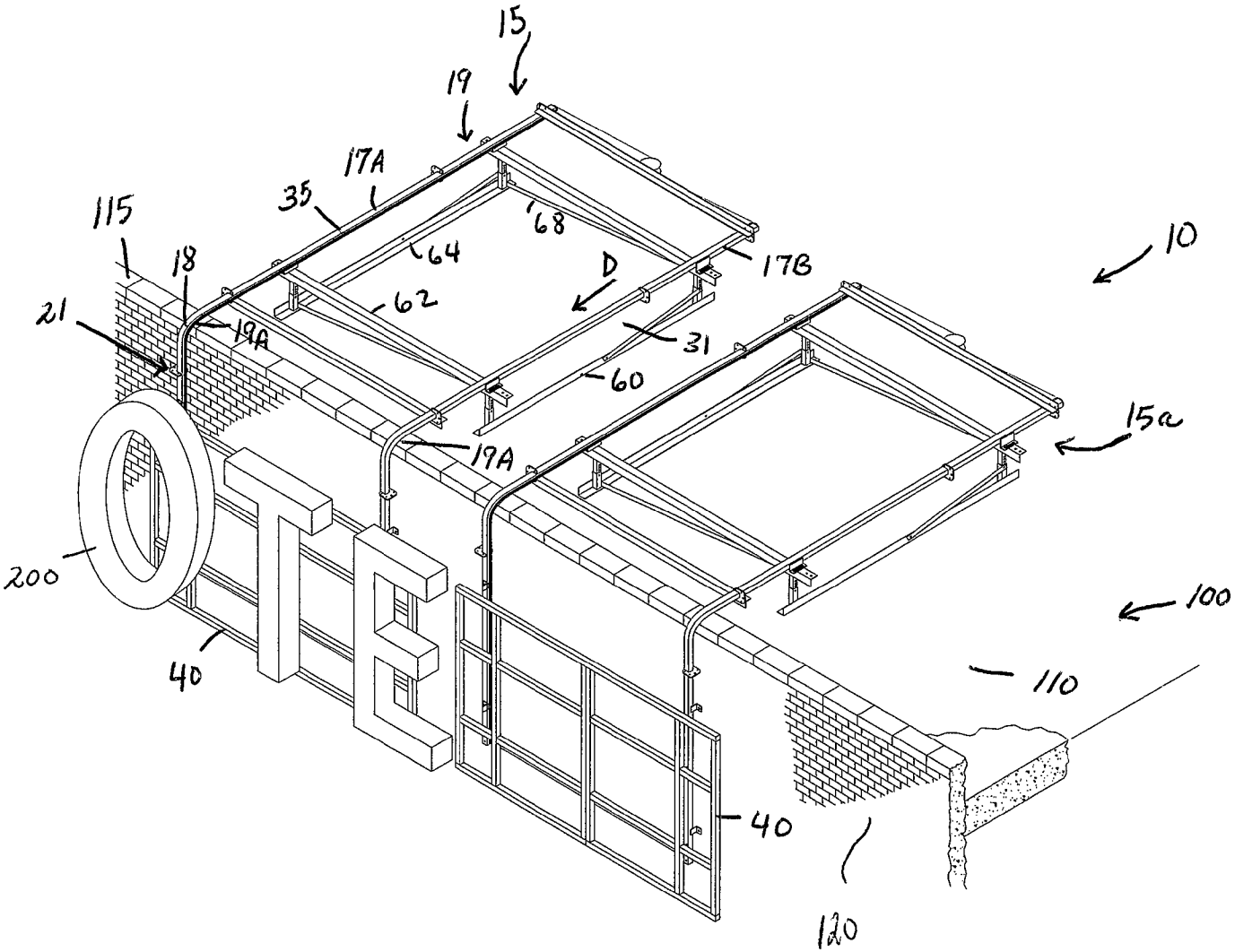
FIG. 1 is a perspective view of a preferred embodiment of the present invention, a system for mounting a tower display, the system illustrated is in the display position.

In accordance with the present invention, a system for mounting a tower display is disclosed. More particularly, the described system relates to an apparatus for installing and maintaining a sign typically placed around the exterior top of a tower, high rise building or other structure. Specifically, it will be noted in the following description that the present system introduces a cost efficient solution for not only installing the display on a high rise building but also providing maintenance to the display once installed. The system introduces a solution that avoids the drawbacks associated with the prior art methods including, but not limited to, workers safety, damage to the landscape area adjacent the building, and the costs associated with setting up and tearing down the equipment generally used. In the broadest context, the system for mounting a tower display consists of components configured with respect to each other so as to attain the desired objective.

The present invention is now exemplified by a particular embodiment which is illustrated in the accompanying drawings.

The system for mounting a tower display designated as numeral 10 generally includes at least one guide system designated as numeral 15 in the drawings. While the drawings show a system for mounting a tower display having two (2) guide systems (designated 15 and 15*a*), the following description will describe in detail the embodiments of guide system 15, it being understood that any remaining guide systems, including the guide system 15*a* illustrated have the identical embodiments as guide system 15 and are merely being illustrated in the drawings. It should be understood further that while the drawings illustrate a system 10 having two (2) guide systems, the present system 10 anticipates a mounting system having any number of guide systems as described.

Figure 4:
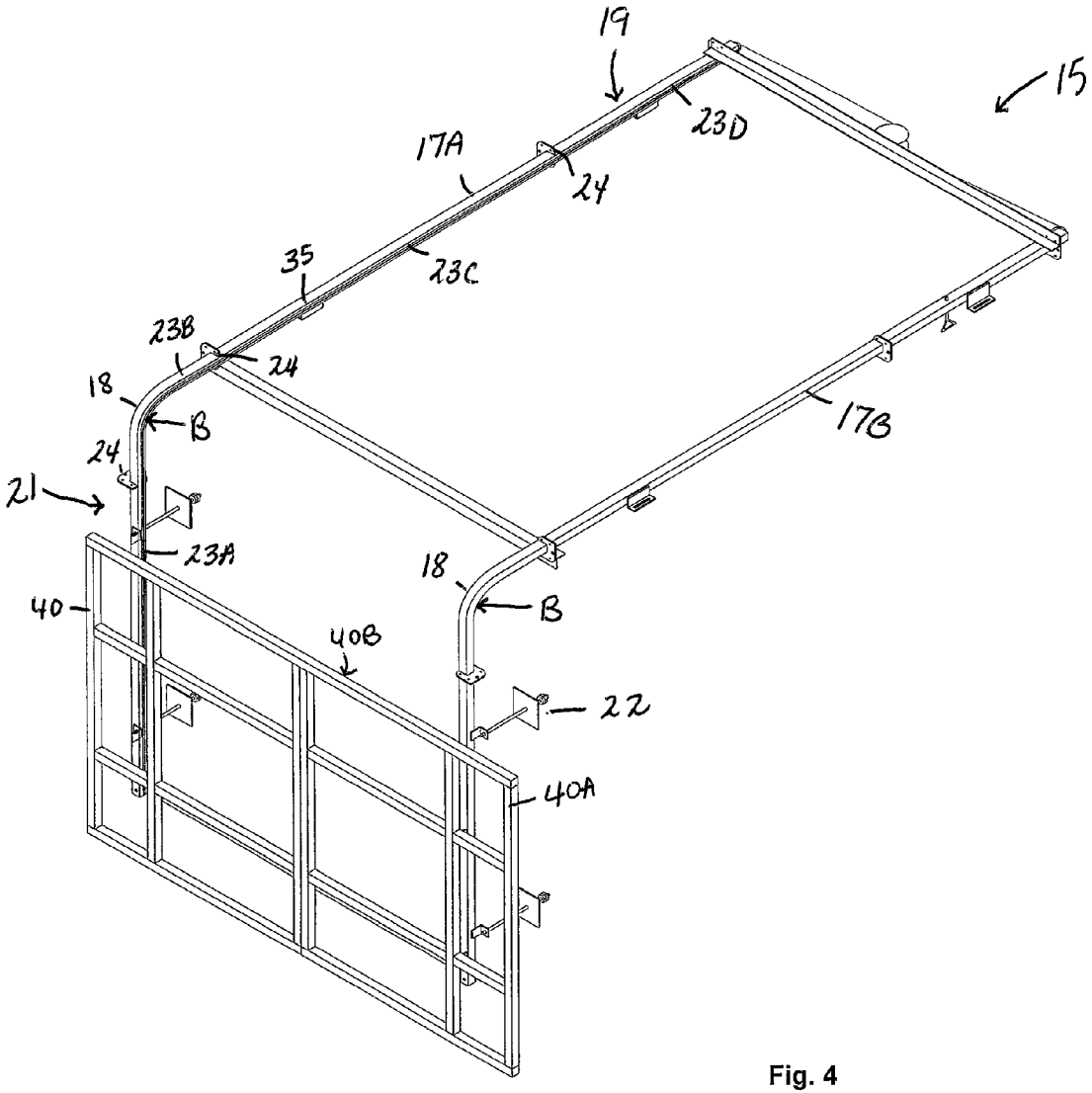
FIG. 4 illustrates the guide system of the present invention.

The guide system 15 generally includes a pair of guide rails 17A and 17B in spaced apart relationship. As best illustrated in FIG. 4, the guide rails 17A, 17B having a first end 19 accessible from the structure's 100 roofing surface 110 as will be further described, and a second end 21 attached to the side wall 120 of the structure 100. Again, the guide rail 17A includes components identical to guide rail 17B. As such, the following description will describe the embodiments of rail 17A, it being understood that guide rail 17B has the identical embodiments as guide rail 17A.

In the preferred embodiment, the second end 21 of guide rail 17A is attached to the side wall 120 of the structure 100 from the inside of the structure using couplings 22 (FIG. 4) known in the art. However, the second end 21 can also be attached to the side wall 120 from the exterior of the structure 100 using means known in the art.

As illustrated, and as will be further described, the first end 19 of the guide rail 17A is releasably attached to a support stand 60. In the alternative, the first end 19 can be attached to vertical supports (not shown) having a top end attached to the first end of the rail 17A and an opposite end appropriately attached to the roofing surface 110.

The guide rails 17A, 17B further define a turn 18 which links the first end 19 of the guide rail to the second end 21. More particularly, the turn 19 is situate the roofing surface's edge 115 and defines a spacing 19A (best shown in FIG. 5) that is approximately adjacent the roofing surface's edge 115. Referring to FIG. 4, the turn 19 defines a bend B that is an approximate 90 degree bend.

The guide rails 17A, 17B each have an upper surface that defines a track 35 that extends the length of the rails 17A, 17B. The track 35 is designed for sliding receipt of guide pins 42 of a frame member 40 as will be further described.

Figure 2:
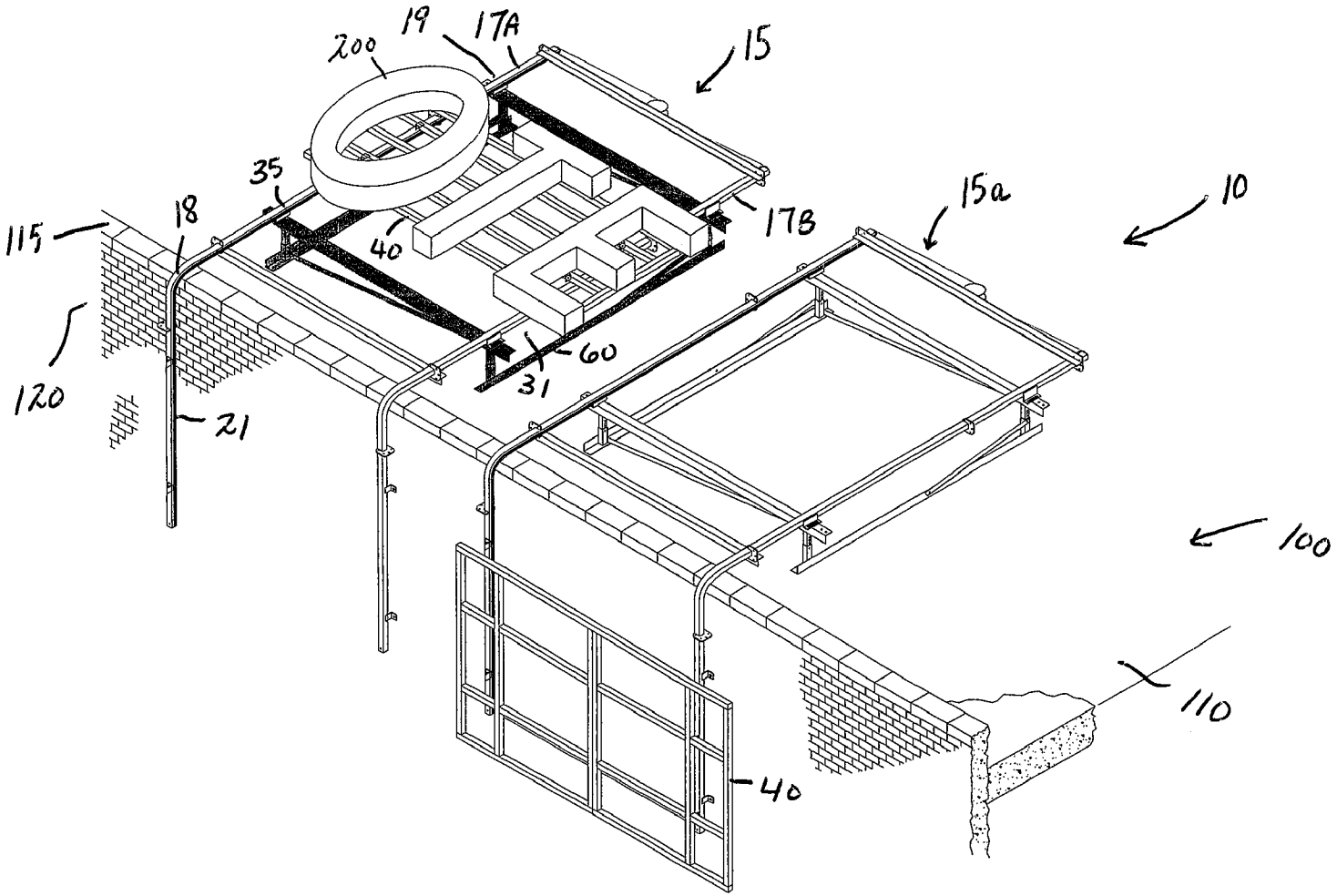
FIG. 2 is a perspective view of the preferred embodiment of the present invention, the system illustrated is in the maintenance position.
Figure 3:
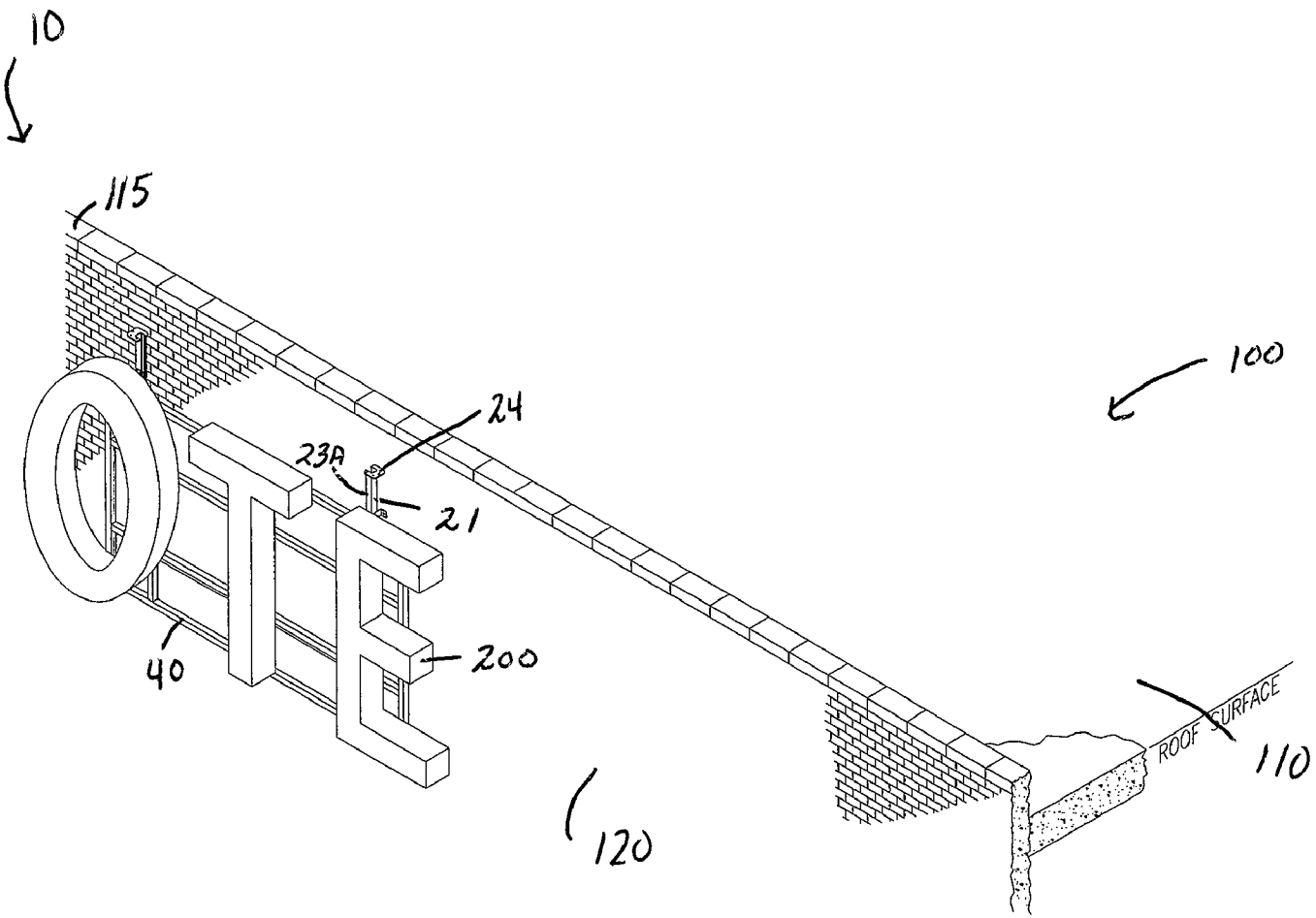
FIG. 3 is a perspective view of the system illustrated in FIG. 1 with sections of the guide rails on the structure's roofing surface removed.

FIGS. 1, 2 and 3 show the guide rails 17A, 17B for each of the guide systems 15, 15*a*, attached to the roofing surface 110 as described. As illustrated, the guide rails 17A, 17B, are shown as having a continuous length that extends along the structure's roof surface 110, defines the turn 18, and downwardly extends the side wall 120 of the structure 100. Preferably, the guide rails are constructed of a plurality of sections designated in FIG. 4 as 23A, 23B, 23C and 23D. It should be understood that while FIG. 4 illustrates the guide rail 17A having four (4) sections, the preferred embodiment anticipates each of the guide rails having at least two (2) sections as described.

Figure 7:
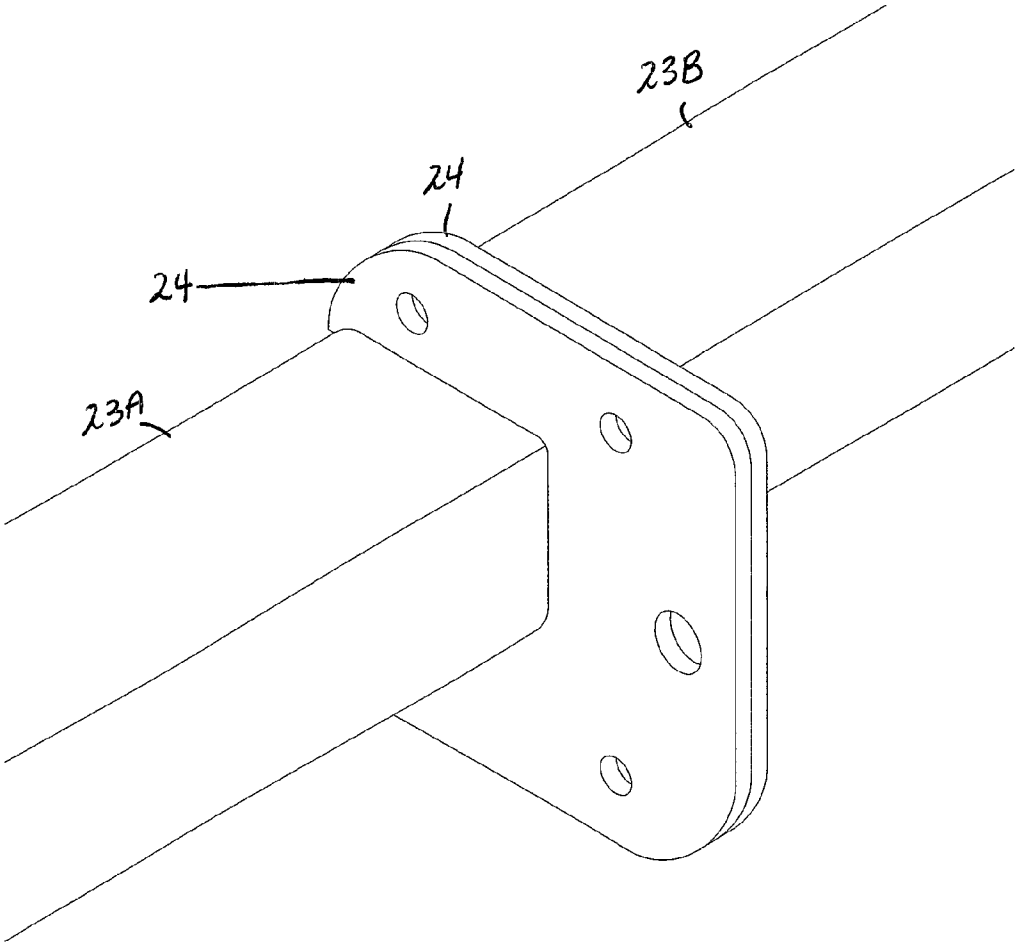
FIG. 7 illustrates sections of the guide rail and flange member.

Referring to FIG. 7, each section of the guide rail 17A includes a flange member 24 on each end for connecting the sections together to form the guide rail having the continuous length as shown.

Figure 6:
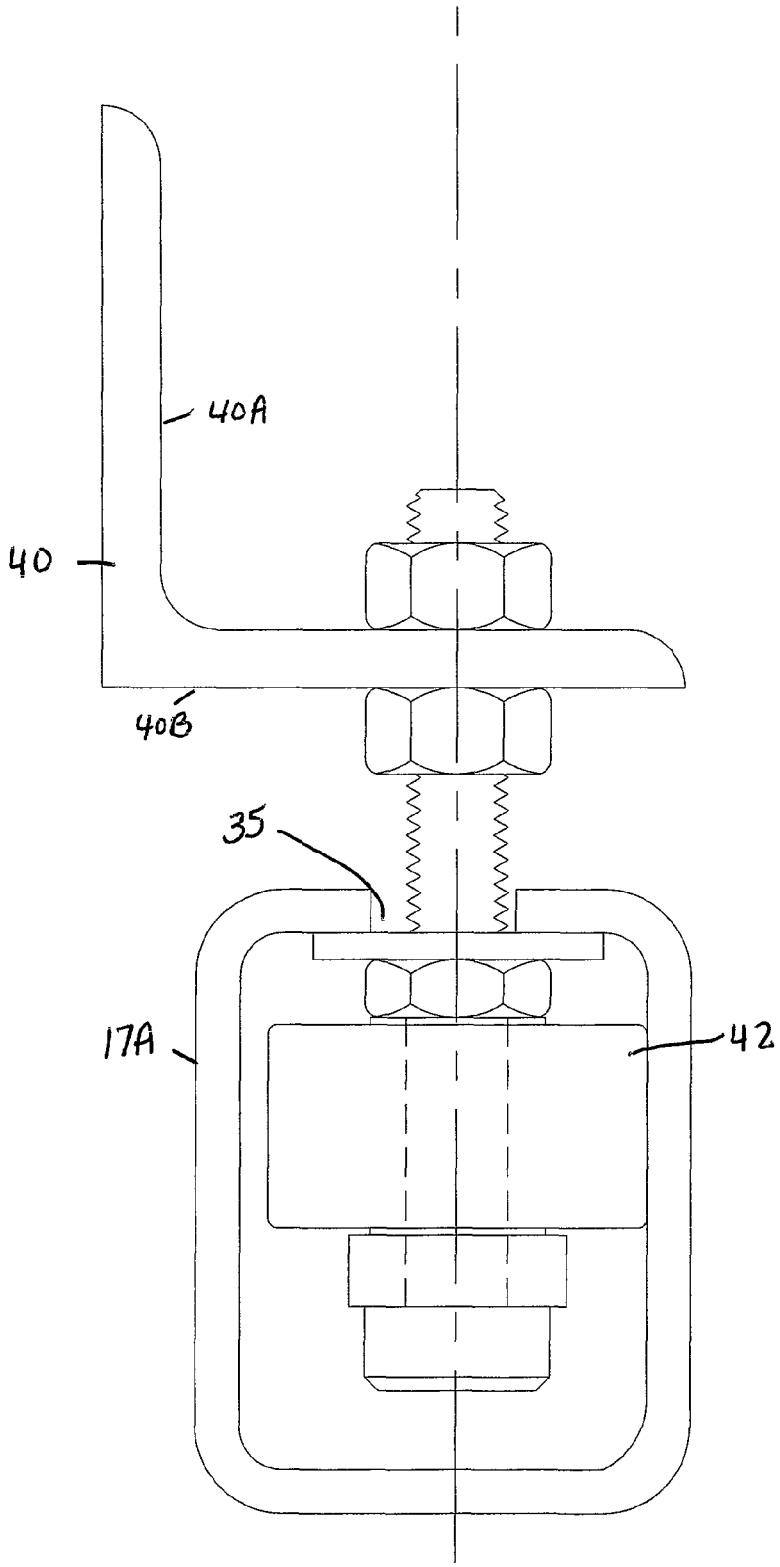
FIG. 6 illustrates the system's track and guide pins of the frame member.

FIGS. 1-4 illustrate the frame member 40 attached to the guide rails 17A, 17B. Referring to FIGS. 4 and 6, frame member 40 includes a top side 40A and a bottom side 40B. The bottom side 40B includes the guide pins 42 that downwardly extends from the member 40, that in application are engaged with the track 35 of each of the guide rails 17A, 17B. As will be understood, the guide pins 42 remain engaged within the track 35 of the guide rails 17A, 17B such that the frame member 40 can be slidingly positioned in a first, or maintenance position as guide system 15 is shown in FIG. 2, where the frame member 40 is positioned on the first end 19 of the guide rails 17A, 17B or, the frame member 40 can be slidingly positioned in a second, or display position as shown in FIGS. 1, 3 and 4, where the frame member 40 is positioned on the second end 21 of the guide rails 17A, 17B.

Figure 5:
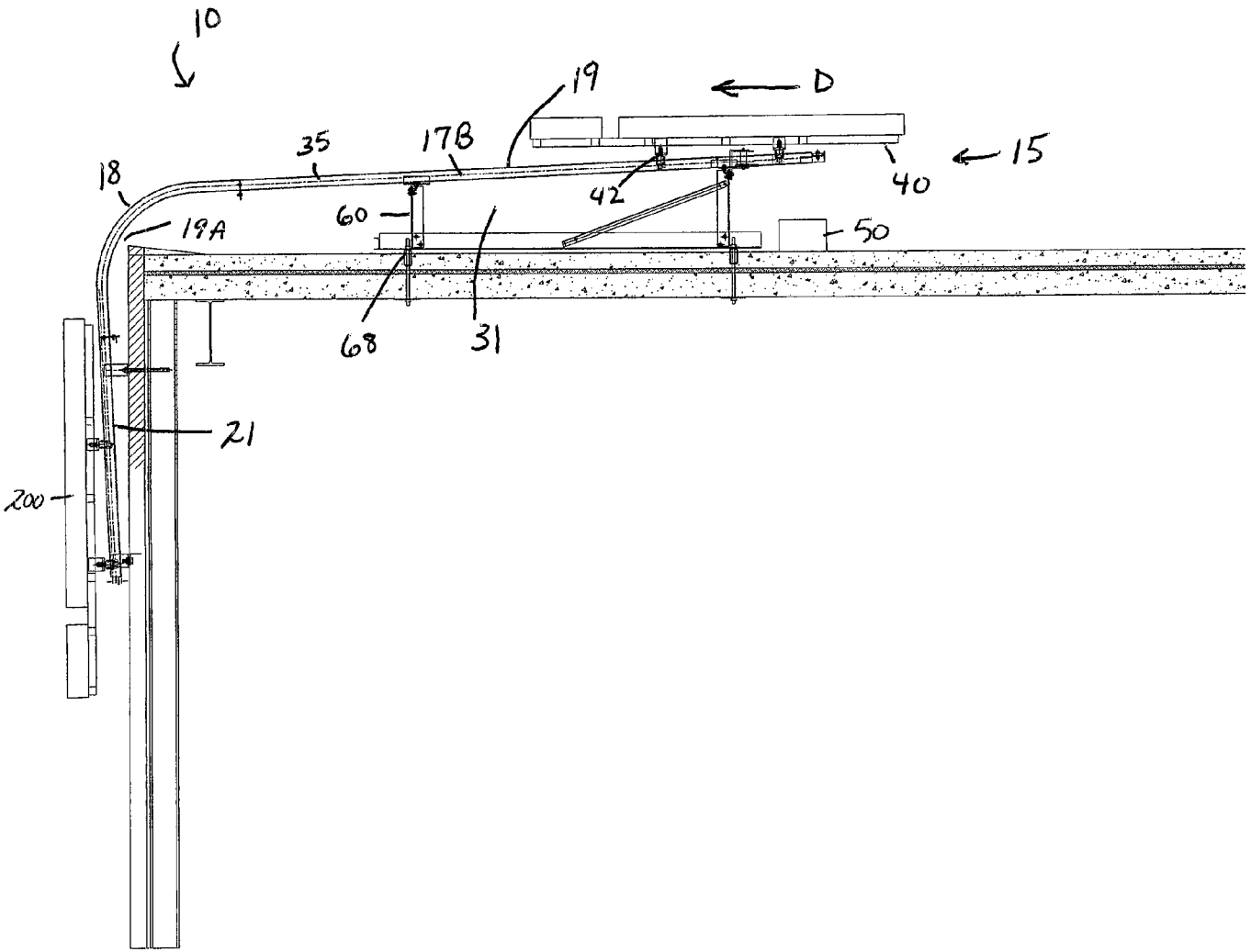
FIG. 5 is a side view of the system illustrated in FIG. 1.

As illustrated, in application, the frame member 40 of each guide system 15, 15*a*, can be slidingly positioned from the maintenance position and display position with a hand winch 50 (shown in FIG. 5). Each guide system can include the hand winch 50 or in the alternative, a single hand winch 50 can be connected to the guide systems collectively.

As illustrated, the selected display 200 is appropriately attached to the top side 40A of the frame member 40 of the guide systems 15, 15*a*. It should now be understood that the number of guide systems required for a particular application is dependant upon the size of the display 200. As should be further understood, the display 200 is attached to the frame members 40 as described with the frame members 40 at the maintenance position so that access is easily available for attachment from the structure's roofing surface 110. Once attached the frame members 40 can be slidingly positioned, using the hand winch 50, along the guide rails 17A, 17B until the frame members 40, with the display 200 attached thereto is in the display position. In the display position, the display 200 is positioned on the top, exterior side 120 of the structure 100.

In the event maintenance is required on the display 200, the frame members 40 can be slidingly positioned, using the hand winch 50, along the guide rails 17A, 17B from the display position until the frame members 40, with the display 200 attached thereto is in the maintenance position. In the maintenance position, the display 200 is easily accessible from the structure's roofing surface 100.

The Inventors have found that once the frame members 40, with the display 200, is in the display position as described, it is advantageous to remove sections of the guide rails on the structure's roofing surface as well as the turn 18 section primarily for aesthetic reasons. Referring to FIG. 3, sections 23B, 23C and 23D have been detached while display 200 remains in the display position.

Figure 8:
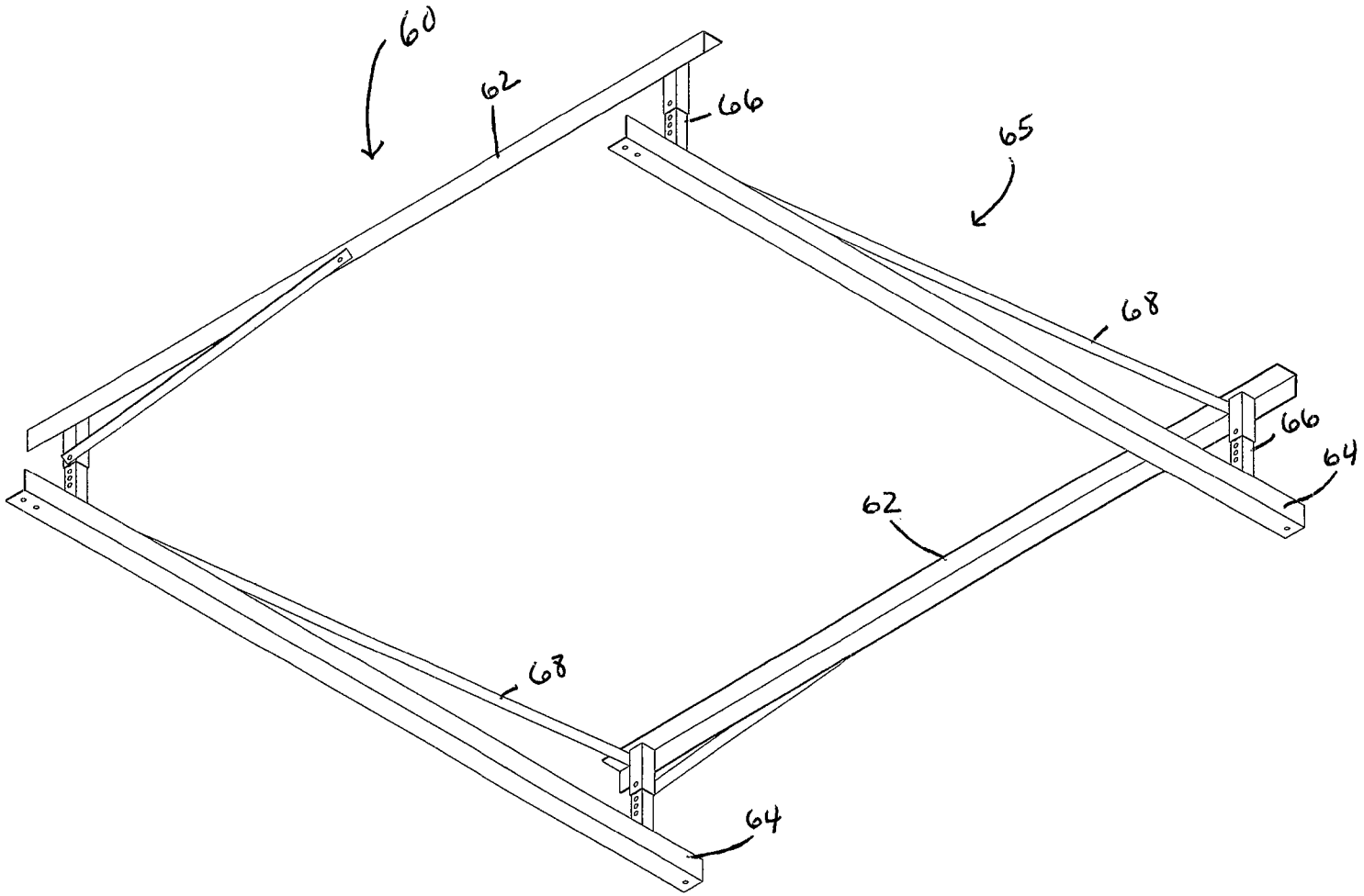
FIGS. 8 and 9 illustrate the system's support stand.
Figure 9:
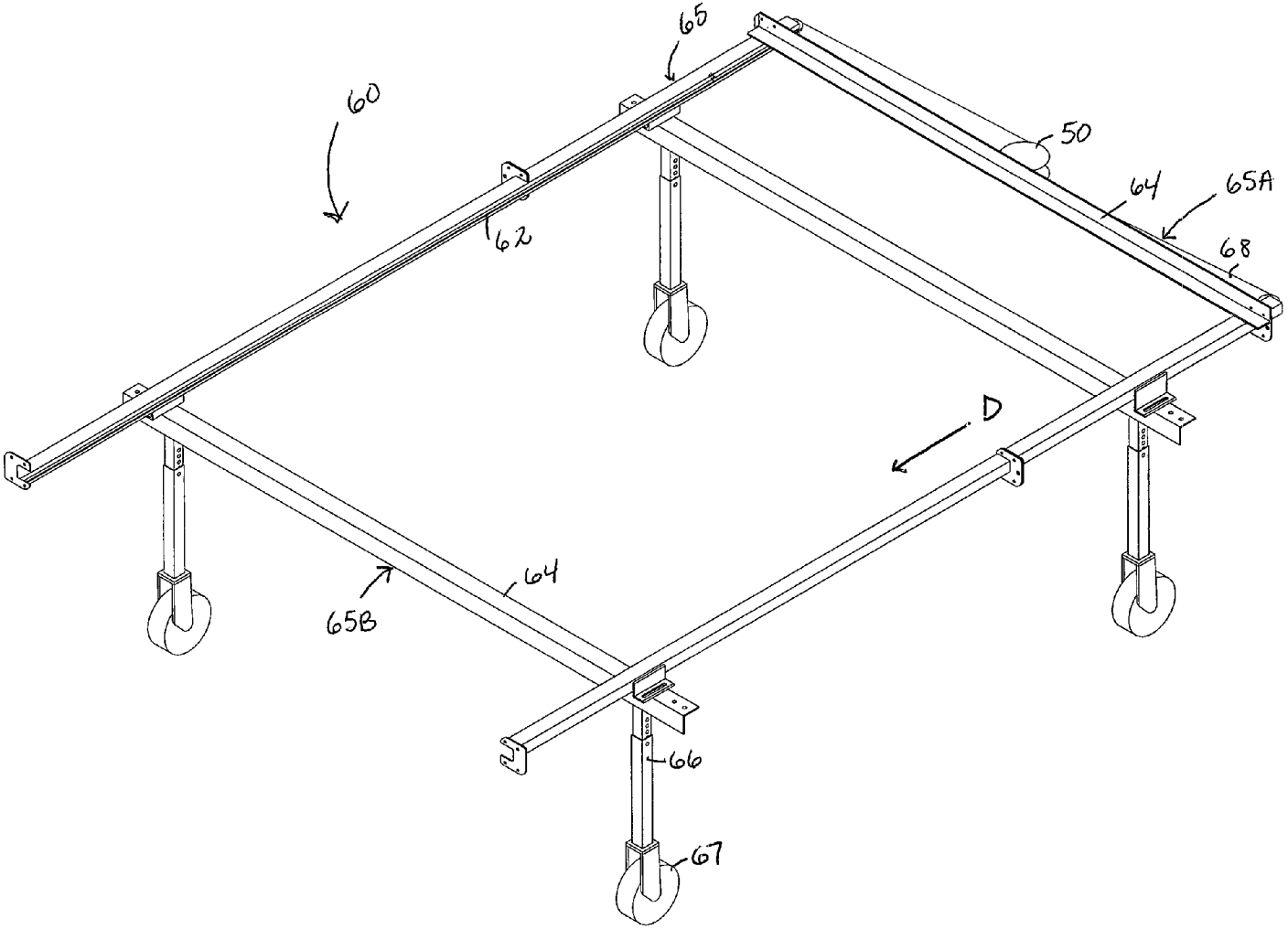

In the preferred embodiment, the first end 19 of the guide rail is releasably attached to the support stand 60. Referring to FIGS. 8 and 9, the support stand 60 includes a pair of upper horizontal supports 62 and a pair of lower horizontal supports 64 that define a frame 65 having a substantially rectangular configuration. As further illustrated, it is preferred that each horizontal support 62, 64 include a brace member 68 that is attached to the horizontal support members for added support.

Vertical leg members 66 are attached to the corners of the frame 65. In the preferred embodiment, the leg members 66 are vertically adjustable such that a first end 65A of the frame 65 (shown in FIG. 9) can be elevated in relation to a second end 65B. The vertical leg member 66 further defines a spacing 31 (best shown in FIGS. 1, 2 and 5) between the guide rails 17A, 17B and the roof surface 110.

In application, the guide rail 17A is releasably attached to the support stand 60 and the raised end 65A defines a slight decline (arrow "D" shows the direction of decline in FIGS. 1, 3 and 9) in the guide rail 17A to allow the frame member 40 to position from the maintenance position to the display position by gravity. In the preferred embodiment, the slight decline "D" is an approximate 10 degree angle.

In the preferred embodiment, the vertical leg member 66 further includes rollers 67 (See FIG. 9) such that the support stand 60 can be easily positioned from one guide system to another. In the alternative, the leg member 66 is appropriately attached 68 (See FIG. 5) to the roofing surface.

Although the description above contains many specificities, these should not be construed as limiting the scope of the invention but as merely providing illustrations of some of the presently preferred embodiments of this invention. Thus the scope of the invention should be determined by the appended claims in the formal application and their legal equivalents, rather than by the examples given.

We claim:

1. A system for installing a display on a structure, said system comprising: at least one guide system comprising:

a pair of guide rails having a first end that is accessible from a structure's roofing surface and a second end that is attached to a side wall of the structure, said guide rails each include a track that extends the approximate length of said guide rails, wherein said track is designed for sliding receipt of at least a pair of guide pins that extend from a first surface of a frame member, wherein said at least a pair of guide pins are engaged within the track of each of the guide rails such that the frame member can be slidingly positioned in a first position where the frame member is positioned at the first end of the guide rails or, the frame member can be slidingly positioned in a second position where the frame member is positioned at the second end of the guide rails;

a display attached to a second surface of the frame member;

wherein said first end of said guide rails is releasably attached to a support stand, said support stand comprising upper and lower horizontal supports that define a frame having a substantially rectangular configuration and having vertical leg members attached to corners of the frame.

2. The system as recited in claim 1, wherein said pair of guide rails are in spaced apart relation.

3. The system as recited in claim 2, wherein each of said guide rails further define a turn disposed between said first and second ends.

4. The system as recited in claim 3, wherein said turn is approximately adjacent to a roofing surface's edge of the structure and said turn defines a bend that is an approximate 90 degree bend.

5. The system as recited in claim 1, wherein each of said guide rails are constructed of a plurality of sections.

6. The system as recited in claim 5, wherein each of said sections include a flange member for releasably connecting each of said sections together to form said guide rail.

7. The system as recited in claim 1, further including a winch attached to said frame member for slidingly positioning said frame member from the first position to the second position.

8. The system as recited in claim 1, wherein said vertical leg members are adjustable such that a first end of said frame can be elevated in relation to a second end of said frame, wherein said first and second ends of said frame define a decline.

9. The system as recited in claim 8, wherein said decline is an approximate 10 degree angle.

10. The system as recited in claim 8, wherein each of said vertical leg members further include a roller such that the frame can be positioned from one guide system to another.

11. The system as recited in claim 1, wherein said display is a sign.

12. A system for installing a display on a structure, said system comprising:

at least one guide system comprising: a pair of guide rails having a first end that is accessible from a structure's roofing surface and a second end that is attached to a side wall of the structure, and a turn disposed between said first and second ends, said guide rails further include a tracking, wherein said tracking for receiving guide pins of a frame member such that the frame member can be positioned at the first end or the second end of said guide rails;

a display attached to said frame member;

a support stand attached to said first end of said guide rails, said support stand defining a frame having a first end that can be elevated in relation to a second end such that said first and second ends of said frame define a decline.

13. The system as recited in claim 12, wherein said frame including upper and lower horizontal supports that define a substantially rectangular configuration and having vertical leg members attached to corners of the frame.

14. The system as recited in claim 13, wherein said turn is approximately adjacent to a roofing surface's edge of the structure and said turn defines an approximate 90 degree bend.

15. The system as recited in claim 14, wherein each of said guide rails are constructed of a plurality of sections.

16. The system as recited in claim 15, wherein each of said sections include a flange member for releasably connecting each of said sections together to form said guide rail.

17. The system as recited in claim 12, further including a winch attached to said frame member for positioning said frame member.

18. The system as recited in claim 13, wherein each of said vertical leg members further include a roller such that the frame can be positioned from one guide system to another.

19. The system as recited in claim 18, wherein said vertical leg members are adjustable.

* * * * *